US007868866B2

(12) United States Patent
Park

(10) Patent No.: US 7,868,866 B2
(45) Date of Patent: Jan. 11, 2011

(54) LIQUID CRYSTAL DISPLAY HAVING OCB MODE DUMMY LIQUID CRYSTAL CELLS AND DRIVING METHOD THEREOF

(75) Inventor: Jin Woo Park, Ulsan (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 747 days.

(21) Appl. No.: 11/521,563

(22) Filed: Sep. 13, 2006

(65) Prior Publication Data

US 2007/0115235 A1 May 24, 2007

(30) Foreign Application Priority Data

Nov. 23, 2005 (KR) ..... 10-2005-0112575

(51) Int. Cl.
*G09G 3/36* (2006.01)

(52) U.S. Cl. ..... 345/93

(58) Field of Classification Search ..... 345/204–211, 345/690–699, 87–111; 315/169.1–169.4; 349/54

See application file for complete search history.

(56) References Cited

U.S. PATENT DOCUMENTS

2005/0168138 A1* 8/2005 Okunaka et al. ..... 313/504
2005/0184980 A1* 8/2005 Sato et al. ..... 345/204
2006/0092111 A1* 5/2006 Nakao et al. ..... 345/87
2006/0221288 A1* 10/2006 Ota et al. ..... 349/143

FOREIGN PATENT DOCUMENTS

| | | |
|---|---|---|
| JP | 2001-166341 | 6/2001 |
| JP | 2002-311456 | 10/2002 |
| JP | 2003-295226 | 10/2003 |
| KR | 2002-0044280 | 6/2002 |
| KR | 10-2005-0066586 A | 6/2005 |

OTHER PUBLICATIONS

Korean Patent Abstract for Korean Publication No. 1020020044280 A, published on Jun. 15, 2002 in the name of Seung Ho Hong, et al.
Korean Patent Abstracts, Publication No. 1020050066586, dated Jun. 30, 2005, in the name of Seong Yeon Hwang.
Japanese Office action dated Sep. 29, 2009 in corresponding Japanese patent application No. 2006-111218, listing the cited references in this IDS.

* cited by examiner

*Primary Examiner*—Chanh Nguyen
*Assistant Examiner*—Long Pham
(74) *Attorney, Agent, or Firm*—Christie, Parker & Hale, LLP

(57) ABSTRACT

Disclosed is a liquid crystal display (LCD) wherein driving stability is secured. The LCD includes Optically Compensated Birefringence (OCB) mode liquid crystal cells formed where a data line and a scan line cross over within a display region of an LCD panel, a panel driver for driving the data and the scan lines, and OCB mode dummy liquid crystal cells formed within a non-display region of the LCD panel to surround the liquid crystal cells. Liquid crystal in each of the dummy liquid crystal cells sustains a bend state when the liquid crystal cells in the display region are driven corresponding to a data signal applied from the data line.

13 Claims, 3 Drawing Sheets

Vcr>V (splay state)

Vcr<V (bend state)

LIQUID CRYSTAL DISPLAY HAVING OCB MODE DUMMY LIQUID CRYSTAL CELLS AND DRIVING METHOD THEREOF

CROSS-REFERENCE TO RELATED APPLICATION

This application claims priority to and the benefit of Korean Patent Application No. 10-2005-0112575, filed on Nov. 23, 2005, in the Korean Intellectual Property Office, the entire content of which is incorporated herein by reference.

BACKGROUND

1. Field of the Invention

The present invention relates to a liquid crystal display (LCD) and a driving method thereof, and more particularly, to an LCD wherein driving stability can be secured and a driving method for such an LCD.

2. Discussion of Related Art

In recent years, various types of flat panel displays that have a lower weight and volume than cathode ray tubes (CRTs) have been developed. Liquid crystal displays (LCDs), field emission displays (FEDs), plasma display panels (PDPs), organic light emitting displays (OLEDs) and the like are used as flat panel displays.

Since LCDs have advantages in terms of miniaturization, lightweight, low power consumption and the like, they have been gradually highlighted for replacing the existing CRTs. At present, LCDs have been used not only in portable devices such as cellular phones and Personal Digital Assistants (PDAs) but also in large and medium sized devices such as monitors and TVs.

In an LCD, liquid crystal is injected between an upper substrate having a common electrode and the like formed thereon and a lower substrate having a thin film transistor, a pixel electrode and the like formed thereon. Different electric potentials are applied to the pixel electrode and the common electrode so that an electric field is formed therebetween. The arrangement of the liquid crystal between the upper and lower substrates is changed due to the electric field between the pixel and the common electrodes, and thus an image is displayed while transmittance of light is being controlled.

Among the LCDs, an Optically Compensated Birefringence (OCB) mode LCD has the advantages of a wide viewing angle and a high response speed. Therefore, the OCB mode LCD is being actively studied.

As shown in FIGS. 1A and 1B, in an OCB mode LCD, liquid crystal injected between an upper substrate 10 and a lower substrate 12 is initially set to be in a splay state where a voltage V smaller than a transition voltage Vcr is applied to the liquid crystal (V<Vcr). In such a splay state, light is irregularly transmitted as the voltage V increases. Accordingly, in the splay state, unevenness or flicker is produced on an image.

If a voltage V larger than a transition voltage Vcr is applied to the liquid crystal in the splay state, the liquid crystal is converted into a bend state (V>Vcr). In such a bend state, the transmittance of the liquid crystal is linearly decreased as the voltage V increases. Thus, in a conventional OCB mode LCD, a voltage larger than the transition voltage Vcr is applied to liquid crystal cells to convert the liquid crystal into the bend state, and a predetermined image is then displayed.

However, in the conventional OCB mode LCD, the liquid crystal of some of the liquid crystal cells forming the LCD panel returns from a bend state to a splay state. In practice, the liquid crystal returning from the bend state to the splay state mainly occurs in the liquid crystal cells located at the outermost edges of the LCD panel. It can be speculated that these liquid crystal cells do not sustain their bend states because the liquid crystal cells located at the outermost edges of the LCD panel are not affected by the surrounding electric field.

SUMMARY OF THE INVENTION

Accordingly, it is an aspect of the present invention to provide an LCD wherein driving stability can be secured and a driving method for such an LCD.

A first aspect of the present invention provides an LCD including OCB mode liquid crystal cells formed where data lines and scan lines cross over within an effective display region of an LCD panel, a panel driver for driving the data and the scan lines, and OCB mode dummy liquid crystal cells formed within a non-display region of the LCD panel to surround the liquid crystal cells within the effective display region. The effective display region may also be called a display region. The liquid crystal contained in each of the dummy liquid crystal cells sustains a bend state when the liquid crystal cells are driven corresponding to a data signal applied from the data line.

The panel driver may include a scan driver for sequentially applying scan signals to scan lines coupled to the dummy liquid crystal cells and the liquid crystal cells, and a data driver for applying a data signal to data lines coupled to the dummy liquid crystal cells and the liquid crystal cells. The scan driver and the data driver may be both included in a panel driver. The data driver controls a voltage value of a data signal applied to the dummy liquid crystal cells such that a voltage larger than a transition voltage can be applied to liquid crystal in each of the dummy liquid crystal cells.

A second aspect of the present invention provides a method of driving an LCD, the method including displaying an image from OCB mode liquid crystal cells formed within an effective display region, and applying a voltage larger than a transition voltage to liquid crystal in each dummy liquid crystal cell formed within a non-display region when an image is displayed from the liquid crystal cells. The non-display region may surround the display region allowing the dummy liquid crystal cells to impose an electric field upon the liquid crystal cells within the display region.

The transition voltage may be a voltage with which the liquid crystal in each of the dummy liquid crystal cells can change from a splay state to a bend state. The application of a voltage larger than the transition voltage to the dummy liquid crystal cells, includes turning on a TFT included in each of the dummy liquid crystal cells, and applying a data signal to a pixel electrode included in each of the dummy liquid crystal cells when the TFTs are turned on.

In one embodiment, an OCB mode LCD includes an LCD panel that has scan lines, data lines, a display region having liquid crystal cells, and a non-display region having dummy liquid crystal cells. The scan lines cross over the data lines at least within the display region. The non-display region is formed surrounding the display region. The LCD also includes a scan driver for applying scan signals to the scan lines and a data driver for applying data signals to the data lines. The liquid crystal in the dummy liquid crystal cells is maintained in a bend state to impose an electric field upon the liquid crystal cells in the display region. The liquid crystal cells and the dummy liquid crystal cells may be both formed where the scan lines and the data lines cross over. Then the liquid crystal cells and the dummy liquid crystal cells are both coupled to the scan lines and the data lines that are respectively applying the scan signals and the data signals to these cells. In this embodiment, the data signals applied to the dummy liquid crystal cells have a voltage greater than a transition voltage of the liquid crystal. Alternatively, the dummy liquid crystal cells may be coupled to a dummy line applying a dummy voltage to the dummy liquid crystal cells. Then, the dummy voltage applied to the dummy liquid crystal cells is greater than the transition voltage of the liquid crystal.

BRIEF DESCRIPTION OF THE DRAWINGS

These and/or other aspects and features of the invention will become apparent and more readily appreciated from the following description of the exemplary embodiments, taken in conjunction with the accompanying drawings of which.

DETAILED DESCRIPTION

Hereinafter, exemplary embodiments of the present invention will be described in detail with reference to the accompanying FIGS. 2, 3, 4, and 5.

Figure 1A:
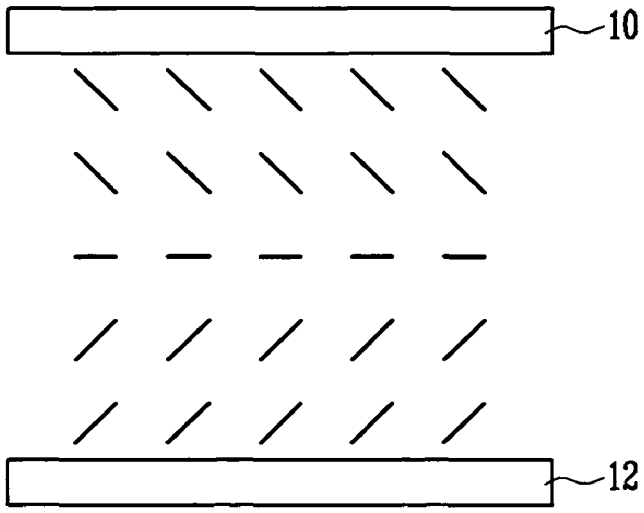
FIG. 1A (PRIOR ART)
FIGS. 1A and 1B are views illustrating movements of an OCB mode liquid crystal depending on a voltage applied thereto.
Figure 1B:
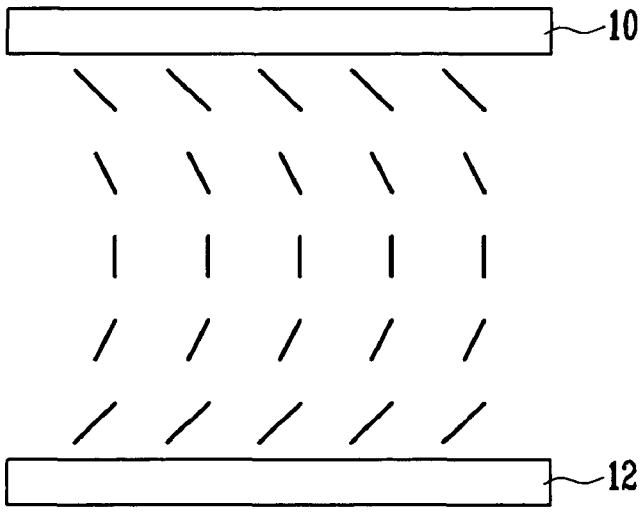
FIG. 1B (PRIOR ART)
Figure 2:
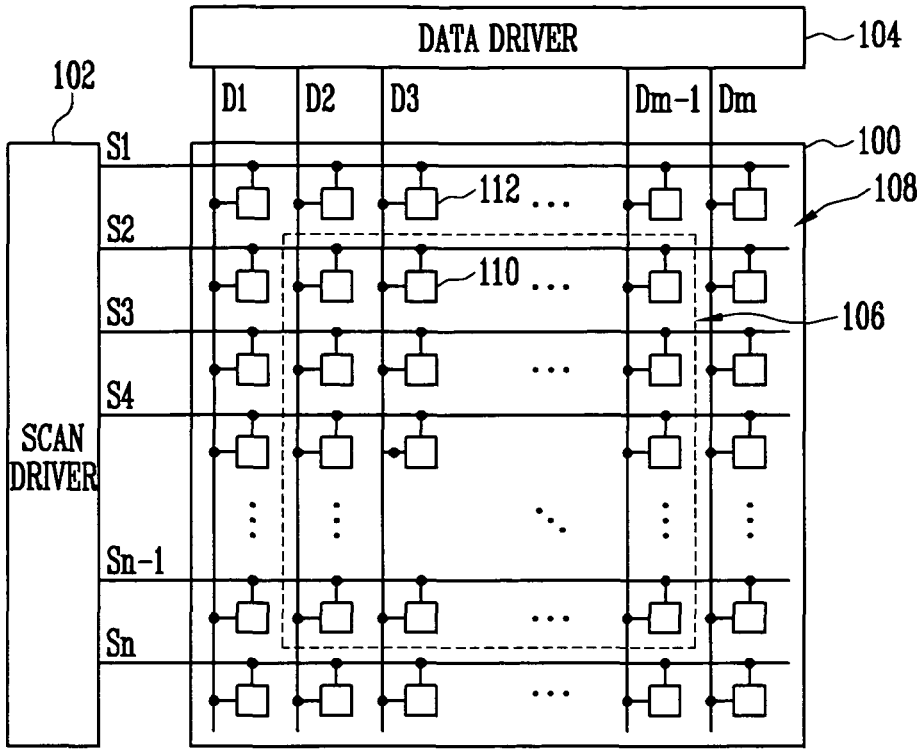
FIG. 2 is a block diagram of an OCB mode LCD according to a first embodiment of the present invention.

FIG. 2 is a block diagram of an OCB mode LCD according to a first embodiment of the present invention.

Referring to FIG. 2, the OCB mode LCD according to the first embodiment of the present invention includes an LCD panel 100, a data driver 104 for applying data signals to data lines D1 to Dm of the LCD panel 100 and a scan driver 102 for applying scan signals to scan lines S1 to Sn of the LCD panel 100.

In the embodiment of FIG. 2, the scan driver 102 and the data driver 104 are shown to be separated from each other. However, the two drivers 102 and 104 may form a single integrated circuit (IC) as a Chip On Glass (COG). A circuit including both the scan driver 102 and the data driver 104 may be referred to as a panel driver.

The scan driver 102 applies the scan signals to the scan lines S1 to Sn. Accordingly, dummy liquid crystal cells 112 and liquid crystal cells 110 are selected by the horizontal lines.

The data driver 104 converts data input from the outside into the data signals and applies the data signals for one horizontal line to the data lines D1 to Dm in every one horizontal period.

The LCD panel 100 is divided into an effective display region 106 and a non-display region 108. The effective display region 106 may also be called a display region. In the effective display region 106, the liquid crystal cells 110 are arranged in a matrix. Each of the liquid crystal cells 110 displays a portion of the image corresponding to a data signal applied thereto. That is, each of the liquid crystal cells 110 located within the effective display region 106 is used to display a portion of the image corresponding to the applied data signal.

In the non-display region 108, the dummy liquid crystal cells 112 are arranged to surround the liquid crystal cells 110 formed within the effective display region 106. A voltage larger than a transition voltage Vcr is applied to liquid crystal in each of the dummy liquid crystal cells 112 to sustain a bend state. That is, the dummy liquid crystal cells 112 located within the non-display region 108 provide an electric field to the liquid crystal cells 110 formed at the outer edges of the effective display region 106 while sustaining their bend states, so that the liquid crystal cells 110 formed within the effective display region 106 are prevented from returning to their splay states. Meanwhile, the dummy liquid crystal cells 112 located within the non-display region 108 have no influence on the image to be displayed. For example, a black matrix may be formed on the non-display region 108 of the LCD panel 100 to cover the dummy liquid crystal cells 112, thereby preventing light from the dummy liquid crystal cells 112 from being radiated to the outside.

Figure 3:
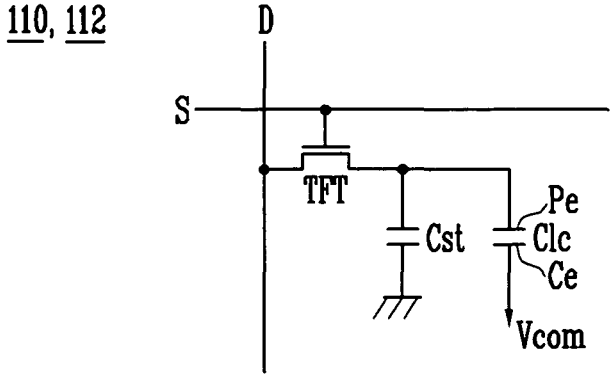
FIG. 3 is a circuit diagram of a liquid crystal cell and dummy liquid crystal cell of the LCD of FIG. 2.

FIG. 3 is a circuit diagram of the liquid crystal cell and the dummy liquid crystal cell of the LCD shown in FIG. 2.

Referring to FIG. 3, each of the liquid crystal cells 110 and the dummy liquid crystal cells 112 includes a thin film transistor (TFT) located between a scan line S and a data line D, and a liquid crystal capacitor Clc is coupled to the TFT.

The liquid crystal capacitor Clc is used to express the equivalent capacitance formed by liquid crystal interposed between a pixel electrode Pe coupled to a drain electrode of the TFT and a common electrode Ce formed on an upper substrate of the LCD. Further, each of the liquid crystal cells 110 and the dummy liquid crystal cells 112 also includes a storage capacitor Cst.

During operation, the TFT is first turned on in response to a scan signal applied to the scan line S. If the TFT is turned on, a data signal applied to the data line D is applied to the pixel electrode Pe via the TFT. Then, the light transmittance of the liquid crystal is controlled by a voltage applied between the pixel electrode Pe and the common electrode Ce. A voltage corresponding to the data signal may be charged in the storage capacitor Cst to be applied to the pixel electrode Pe for one frame period.

In the described embodiments of the present invention, a voltage larger than the transition voltage Vcr is applied to liquid crystal in each of the dummy liquid crystal cells 112 when the liquid crystal cells 110 are driven. Then, the dummy liquid crystal cells 112 sustain their bend states. There may be various methods to apply a voltage larger than the transition voltage Vcr to the liquid crystal in the dummy liquid crystal cells 112. For example, in a case where the common electrode Ce is fixed to a ground voltage, the voltage of the data signal applied to the pixel electrode Pe is such that a voltage larger than the transition voltage Vcr can be applied to the liquid crystal. Further, in a case where the common electrode Ce is inverted into a positive or negative voltage, a data signal corresponding to the inversion voltage is applied to the dummy liquid crystal cells 112 so that a voltage larger than the transition voltage Vcr can be applied to the liquid crystal. As such, if the liquid crystal in the dummy liquid crystal cells 112 sustains a bend state while a voltage larger than the transition voltage Vcr is applied to the liquid crystal, the liquid crystal cells 110 formed within the effective display region 106 can stably sustain their bend states so that a desired image can be displayed.

Figure 4:
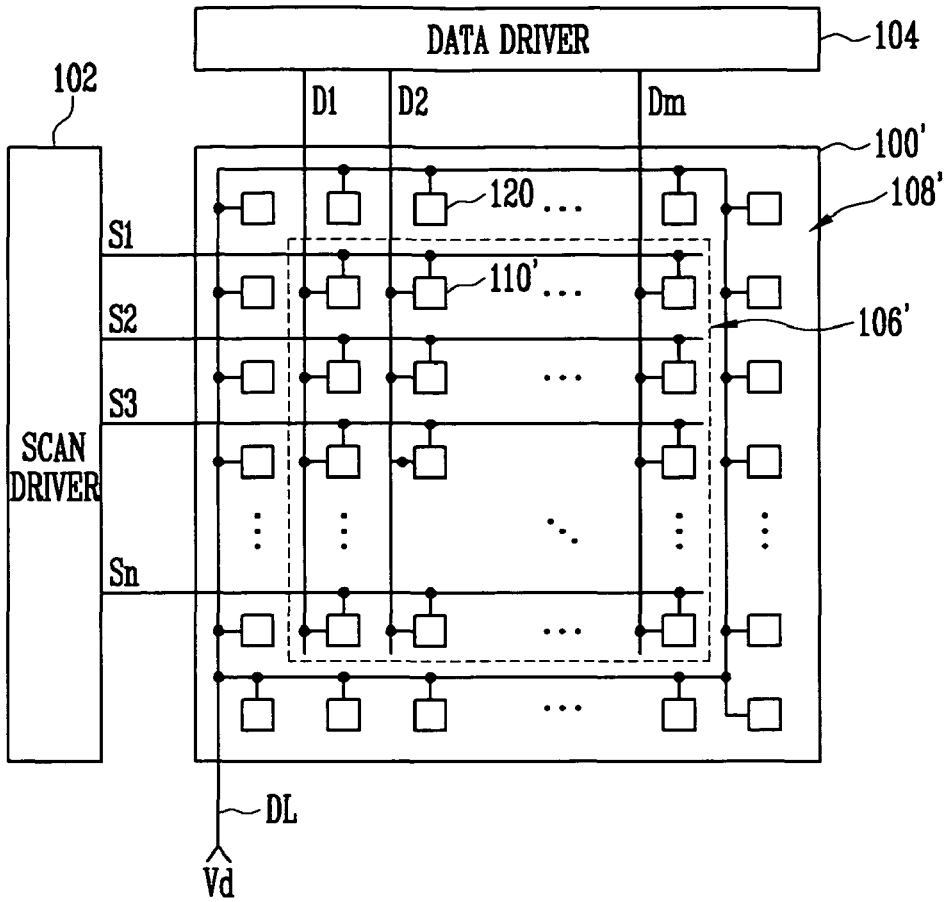
FIG. 4 is a block diagram of an OCB mode LCD according to a second embodiment of the present invention.

FIG. 4 is a block diagram of an OCB mode LCD according to a second embodiment of the present invention. When describing FIG. 4, like elements to the elements shown in FIG. 2 are designated by like reference numerals and their detailed description is omitted.

Referring to FIG. 4, the OCB mode LCD of the second embodiment includes an LCD panel 100', a data driver 104 for applying the data signals to data lines Dl to Dm of the LCD panel 100' and a scan driver 102 for applying scan signals to scan lines S1 to Sn of the LCD panel 100'.

In an effective display region 106', liquid crystal cells 110' are formed. Each of the liquid crystal cells 110' displays a portion of the image corresponding to a data signal applied thereto. The liquid crystal cells 110' are similar to the liquid crystal cells 110 of the first embodiment.

In a non-display region 108' of the LCD panel 100', dummy liquid crystal cells 120 are arranged to surround the liquid crystal cells 110'. A voltage larger than the transition voltage Vcr is applied to liquid crystal in each of the dummy liquid crystal cells 120 to sustain a bend state. That is, the dummy liquid crystal cells 120 provide an electric field to the liquid crystal cells 110' to sustain the bend state in the liquid crystal cells 110'. As a result, the liquid crystal cells 110' are prevented from returning to their splay states.

In the second embodiment, the dummy liquid crystal cells 120 are commonly coupled to a dummy line DL. The dummy line DL is coupled to a dummy voltage Vd. A voltage value of the dummy voltage Vd is set and controlled such that the liquid crystal contained or included in the dummy liquid crystal cells 120 sustains a bend state.

Figure 5:
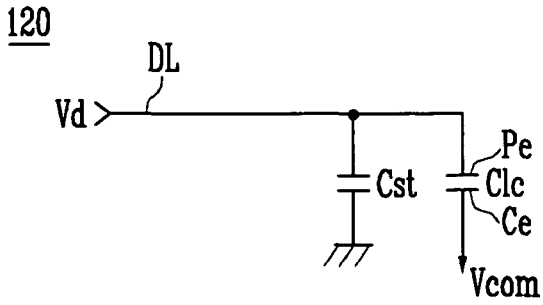
FIG. 5 is a circuit diagram of a dummy liquid crystal cell of the LCD of FIG. 4.

FIG. 5 is a circuit diagram of the dummy liquid crystal cell of the LCD shown in FIG. 4.

Referring to FIG. 5, each of the dummy liquid crystal cells 120 includes liquid crystal interposed between a pixel electrode Pe and a common electrode Ce. The pixel electrode Pe, the liquid crystal and the common electrode Ce are equivalently expressed as a liquid crystal capacitor Clc. Further, each of the dummy liquid crystal cells 120 also includes a storage capacitor Cst. Some embodiments may not include the storage capacitor Cst.

All the pixel electrodes Pe included in the dummy liquid crystal cells 120 are electrically connected to a dummy line DL. That is, in the second embodiment, the pixel electrode Pe is not electrically connected to the dummy line DL via a TFT but is electrically connected to the dummy line DL such that a dummy voltage Vd is applied to the pixel electrode Pe. Here, a voltage value of the dummy voltage Vd is set or controlled such that a voltage larger than the transition voltage Vcr is applied to the liquid crystal contained or included in each of the dummy liquid crystal cells 120. For example, in a case where the common electrode Ce is fixed to a ground voltage, the dummy voltage Vd is set to a voltage larger that the transition voltage Vcr such that the liquid crystal sustains a bend state. Further, in a case where the common electrode Ce is inverted into a positive or negative voltage, the voltage value of the dummy voltage Vd is set to have a relationship with the inversion voltage such that the liquid crystal sustains a bend state. As such, if the liquid crystal in the dummy liquid crystal cells 112 sustains a bend state while a voltage larger than the transition voltage Vcr is applied to the liquid crystal, the liquid crystal cells 110 formed within the effective display region 106 can sustain their stable bend states so that a desired image can be displayed.

As described above, in an LCD and a method for driving the LCD according to the embodiments of the present invention, dummy pixels are formed within a non-display region, and liquid crystal of the dummy pixels sustains a band state, thereby preventing liquid crystal cells included within an effective display region from being returned to a splay state. Accordingly, in the LCD and the method for driving the LCD according to the embodiments of the present invention, an image can be stably displayed within an effective display region.

Although certain exemplary embodiments of the present invention have been shown and described, it would be appreciated by those skilled in the art that changes might be made to these embodiments without departing from the principles and spirit of the invention, the scope of which is defined by the claims and their equivalents.

What is claimed is:

1. A liquid crystal display (LCD), comprising:

optically compensated birefringence (OCB) mode liquid crystal cells formed where data lines and scan lines cross over within a display region of an LCD panel;

a panel driver for driving the data lines and the scan lines;

OCB mode dummy liquid crystal cells formed within a non-display region of the LCD panel surrounding the liquid crystal cells, each of the dummy liquid crystal cells not including a thin-film transistor (TFT) and comprising a pixel electrode; and a dummy line separate from the data lines and the scan lines for applying a dummy voltage to the pixel electrode in each of the dummy liquid crystal cells, wherein liquid crystal in each of the dummy liquid crystal cells sustains a bend state when the liquid crystal cells in the display region are driven corresponding to a data signal applied from the data lines, and wherein each of the dummy liquid crystal cells further comprises:

a liquid crystal capacitor having the pixel electrode coupled to the dummy line and a common electrode coupled to a common voltage; and a storage capacitor coupled between the pixel electrode and another common voltage.

2. The LCD of claim 1, wherein the panel driver comprises:

a scan driver for applying a scan signal to the scan lines coupled to the liquid crystal cells; and a data driver for applying the data signal to the data lines coupled to the liquid crystal cells.

3. The LCD of claim 2, wherein a voltage value of the dummy voltage applied to the dummy liquid crystal cells is greater than a transition voltage of the liquid crystal in each of the dummy liquid crystal cells.

4. The LCD of claim 2, wherein each of the liquid crystal cells further comprises:

a TFT turned on when the scan signal is applied thereto; and a pixel electrode for applying a voltage corresponding to the data signal to the liquid crystal when the TFT is turned on.

5. The LCD of claim 1, further comprising:

a dummy voltage source, wherein the dummy line electrically connects the dummy voltage source to the pixel electrode in each of the dummy liquid crystal cells.

6. The LCD of claim 5, wherein a voltage value of the dummy voltage source is controlled such that a voltage larger than a transition voltage can be applied to the liquid crystal in each of the dummy liquid crystal cells.

7. A method of driving a liquid crystal display (LCD), the method comprising:

displaying an image from optically compensated birefringence (OCB) mode liquid crystal cells formed where data lines and scan lines cross within a display region of the LCD; and applying a voltage larger than a transition voltage using a dummy line separate from the data lines and the scan lines to liquid crystal in each of dummy liquid crystal cells formed within a non-display region surrounding the display region when the image is displayed on the OCB mode liquid crystal cells, wherein each of the dummy liquid crystal cells does not include a thin-film transistor (TFT) and comprises a pixel electrode, wherein the dummy line is electrically connected to the pixel electrode in each of the dummy liquid crystal cells, and wherein each of the dummy liquid crystal cells further comprises:

a liquid crystal capacitor having the pixel electrode coupled to the dummy line and a common electrode coupled to a common voltage; and a storage capacitor coupled between the pixel electrode and another common voltage.

8. The method of claim 7, wherein the transition voltage is a voltage capable of changing the liquid crystal in each of the dummy liquid crystal cells from a splay state to a bend state.

9. The method of claim 7, wherein the applying a voltage larger than the transition voltage, comprises:

applying a dummy voltage to the pixel electrode in each of the dummy liquid crystal cells.

10. The method of claim 7, wherein the pixel electrode in each of the dummy liquid crystal cells is coupled to a dummy voltage source through the dummy line, and a voltage of the dummy voltage source is controlled such that a voltage larger than the transition voltage can be applied to the liquid crystal in each of the dummy liquid crystal cells.

11. An optically compensated birefringence (OCB) mode liquid crystal display (LCD) comprising:

an LCD panel comprising scan lines, data lines, a display region having a plurality of liquid crystal cells, and a non-display region having a plurality of dummy liquid crystal cells, each of the plurality of dummy liquid crystal cells not including a thin-film transistor (TFT) and comprising a pixel electrode, the scan lines crossing over the data lines at least within the display region, the non-display region surrounding the display region;

a scan driver for applying scan signals to the scan lines;

a data driver for applying data signals to the data lines; and a dummy line separate from the data lines and the scan lines for applying a dummy voltage to the pixel electrode in each of the dummy liquid crystal cells, wherein liquid crystal in the dummy liquid crystal cells is maintained in a bend state, and wherein each of the dummy liquid crystal cells further comprises:

a liquid crystal capacitor having the pixel electrode coupled to the dummy line and a common electrode coupled to a common voltage; and a storage capacitor coupled between the pixel electrode and another common voltage.

12. The LCD of claim 11, wherein the liquid crystal cells are formed where the scan lines and the data lines cross over, wherein the liquid crystal cells are coupled to the scan lines and the data lines respectively applying the scan signals and the data signals to the liquid crystal cells, wherein the dummy liquid crystal cells are coupled to the dummy line applying the dummy voltage to the dummy liquid crystal cells, wherein the dummy voltage applied to the dummy liquid crystal cells is greater than a transition voltage of the liquid crystal in each of the dummy liquid crystal cells.

13. The LCD of claim 12, wherein the liquid crystal cells each comprise:

a TFT having a gate coupled to one of the scan lines and a first terminal coupled to one of the data lines; and a liquid crystal capacitor having a pixel electrode coupled to a second terminal of the TFT and a common electrode coupled to a common voltage; and a storage capacitor coupled between the pixel electrode and another common voltage.

* * * * *